US005894197A

United States Patent [19]

Langlois

[11] Patent Number: 5,894,197

[45] Date of Patent: Apr. 13, 1999

[54] DEVICE FOR ATTENUATING UNWANTED WAVES IN AN ELECTRON TUBE

[75] Inventor: Michel Langlois, Concise/Thonon, France

[73] Assignee: Thomas Tubes Electroniques, Meudon La Foret, France

[21] Appl. No.: 08/586,819

[22] PCT Filed: Jul. 22, 1994

[86] PCT No.: PCT/FR94/00926

§ 371 Date: Jan. 30, 1996

§ 102(e) Date: Jan. 30, 1996

[87] PCT Pub. No.: WO95/04366

PCT Pub. Date: Feb. 9, 1995

[30] Foreign Application Priority Data

Jul. 30, 1993 [FR] France ..... 93 09432

[51] Int. Cl.[6] ..... H01J 23/54

[52] U.S. Cl. ..... 315/5; 315/5.37; 315/39; 333/81 R; 333/81 B

[58] Field of Search ..... 315/4, 5, 5.37, 315/39; 330/44, 45; 333/81 R, 81 B, 227, 251

[56] References Cited

U.S. PATENT DOCUMENTS

| | | | |
|---|---|---|---|
| 3,995,241 | 11/1976 | Mourier | 315/39 X |
| 4,034,258 | 7/1977 | Mourier | 315/39 |
| 4,174,492 | 11/1979 | Holle | 315/39 |
| 4,349,424 | 9/1982 | Sovey et al. | 315/5.38 X |
| 4,529,911 | 7/1985 | Hutter | 315/39 |

*Primary Examiner*—Benny T. Lee

*Attorney, Agent, or Firm*—Oblon, Spivak, McClelland, Maier & Neustadt, P. C.

[57] ABSTRACT

The present invention relates to a device for attenuating unwanted waves appearing in an electron tube which includes at least two coaxial cylindrical electrodes (2, 3). The electrodes (2, 3) contribute to forming the walls of a coaxial resonator. The unwanted waves to be attentuated generate surface currents in the walls of the coaxial resonator. The attenuation device includes several electrically conducting resistive elements (10) inserted into at least one wall of the resonator and arranged so as to cut the surface currents.

21 Claims, 3 Drawing Sheets

DEVICE FOR ATTENUATING UNWANTED WAVES IN AN ELECTRON TUBE

BACKGROUND OF THE INVENTION

1. Field of the Invention

The present invention relates to a device for attenuating unwanted waves in which can develop electron tubes having coaxial cylindrical electrodes.

This attenuation device is particularly advantageous in a grid tube in order to avoid the appearance of undesirable modes, especially the TE11 mode.

2. Discussion of the Background

Grid tubes are generally of the tetrode or triode type. A triode is represented diagrammatically in FIG. 1 to which reference is made. It includes cylindrical electrodes mounted coaxially around an axis of revolution XX'. The central electrode is the cathode 1 which emits electrons when it is heated. Around the cathode 1 is a control grid 2 and then an anode 3. In a tetrode there is an extra grid termed the screen grid placed between the control grid 2 and the anode 3.

Each inter-electrode space is associated with a resonant cavity 5 which consists of cylindrical walls 4 extending the electrodes and is limited heightwise by a movable plunger 6 allowing frequency adjustment. In FIG. 1, only the resonant cavity associated with the control grid 2—anode 3 inter-electrode space is represented completely for the sake of clarity.

Linkage between a respective electrode and a corresponding cavity wall 4 is effected by a respective cup-shaped conducting collar 7 fixed to the corresponding electrode and possibly a conducting ring 8 which includes elastic contacts and is inserted between the respective collar 7 and the corresponding wall 4.

Since the electrodes often have to a DC potential with respect to the cathode 1, it is advisable to insert a capacitor for HF short-circuiting and blocking of direct current between a ring 8 and a cylindrical wall for example.

The respective collars 7 are electrically insulated from one another by corresponding ceramic spacers 9 which also have the function of mechanical retention of the electrodes of the tube and a vacuum-tightness function. A difference of several thousand volts may exist between the control grid 2 and the anode 3 for example.

The inter-electrode space associated with its resonant cavity 5 forms a coaxial resonant circuit normally resonating in the TEM mode. The resonant circuit can however resonate in several other modes, some of which are particularly undesirable as for example the TE11 mode. This is the dominant mode of the TE modes in coaxial resonators and it has the lowest cutoff frequency. For a given resonator, the TM modes have much higher cutoff frequencies and present less of a problem. Indeed, the higher the frequency of a guided mode, the greater are the losses which it produces in the walls. The waves corresponding to modes whose cutoff frequency is high weaken rapidly and cannot propagate.

In a grid electron tube operating as an amplifier, a very-high-frequency signal is injected in the region of the cavity of the input resonant circuit situated between the cathode 1 and the control grid 2 and the signal is extracted after amplification in the region of the cavity of the output circuit situated between the control grid 2 and the anode 3.

Under certain conditions, unwanted resonances in undesirable modes set up in the output resonant circuit may excite the input resonant circuit and give rise to sustained oscillations.

Several means are known for avoiding sustained oscillations. These means consist in increasing the losses from the output resonant circuit for the undesirable frequencies.

A first known solution consists in coupling waveguides each terminating in an absorber to the output resonant circuit. These waveguides are stationed radially around the resonant cavity. The dimensions of the guides are chosen so as not to influence the TEM mode. These guides have a cutoff frequency which lies between the frequency of the undesirable modes and the range of frequencies of the amplifier. The opening of these guides forms, in the outer wall of the resonant cavity, series inductances which are traversed by the surface currents generated by the TEM mode. As a consequence the frequency range of the amplifier is lowered.

Moreover, the lower the freqency of the modes to be eliminated, the greater is the cross-section of the guides. There may be difficulties in accommodating several guides at the periphery of the resonant cavity. In any event, even if guides can be accommodated they considerably increase the bulkiness of the base of the tube. It has been proposed to bend them in order to reduce the bulkiness but this solution is expensive to achieve and not truly satisfactory for reducing bulkiness.

Another known solution consists in stationing above the control grid or the screen grid, in the bottom of the anode a cylindrical conducting structure including several resonant circuits of the distributed-constants RLC type tuned to the frequency of the unwanted waves to be attenuated. The material of the structure is chosen so that it exhibits high losses. This solution has the drawback of being selective: the conducting structure operates only within a narrow band since it includes resonant circuits. Given the small amount of room available in the anode, it is difficult, even impossible, to accommodate other conducting structures whose resonant circuits would be tuned to other frequencies to be eliminated.

Another known solution consists in stationing, in the output cavity, ferrites exhibiting high losses for the frequencies of the unwanted waves. However, choosing and positioning the ferrites is difficult. Futhermore, their effectiveness is not necessarily assured in all operating cases.

Accordingly, an object of the present invention is to remedy these drawbacks. To accomplish this, it proposes a device for attenuating unwanted waves for an electron tube with coaxial electrodes which is simple to make and hence cheap, which is effective over a plurality of frequencies and which does not modify the bulkiness of the tube.

SUMMARY OF THE INVENTION

The present invention relates to a device for attenuating unwanted waves appearing in an electron tube which includes at least two coaxial cylindrical electrodes. These two electrodes contribute to forming the walls of a coaxial resonator. The unwanted waves to be attenuated generate surface currents in the walls of the coaxial resonator. According to the invention, the device for attenuating unwanted waves includes electrically conducting resistive elements inserted into at least one wall of the resonator so as to reduce the surface currents generated by the unwanted waves in the wall. These resistive elements are capable of attenuating all the undesirable modes in so far as they are traversed by the surface currents generated by these modes.

In a preferred configuration, the resistive elements are directed along the generatrices of a cylindrical wall of the coaxial resonator. The generatrix of a surface, such as a cylindrical wall, is the line whose motion generates the surface. Therefore, the generatrices of a cylindrical wall are lines along the surface of the wall which are parallel to the longitudinal axis of the cylinder. They do not influence the TEM mode used in the resonator since the surface currents generated by the TEM mode are also directed along the generatrices of the wall.

Use may be made, for example, of parallelepipedal bars which may be fixed into grooves in the wall. An improvement in the effectiveness of the attenuation is obtained by chamfering the edge of the grooves.

It is particularly advantageous to make the resistive elements from pyrolitic graphite on account of its electrical and thermal properties. This is especially the case when the resistive elements are bombarded by the electrons emitted by the cathode.

The invention also relates to an electron tube which includes such a device for attenuating unwanted waves. This electron tube can belong to the family of grid tubes or magnetrons.

BRIEF DESCRIPTION OF THE DRAWINGS

Other characteristics and advantages of the invention will emerge from the following description given by way of non-limiting example and illustrated by the appended figures which represent.

DESCRIPTION OF THE PREFERRED EMBODIMENTS

Figure 2A:
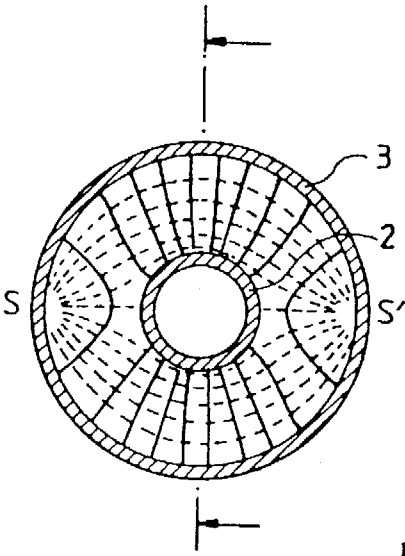
FIG. 2a PRIOR ART
FIG. 2*a:* the electric and magnetic field lines in a cross section of a prior art coaxial resonator, for the TE11 mode.

Referring now to the drawings, like reference numerals designate identical or corresponding parts which may not be described in detail for all figures. Scale is not preserved for the sake of clarity.

Figure 1:
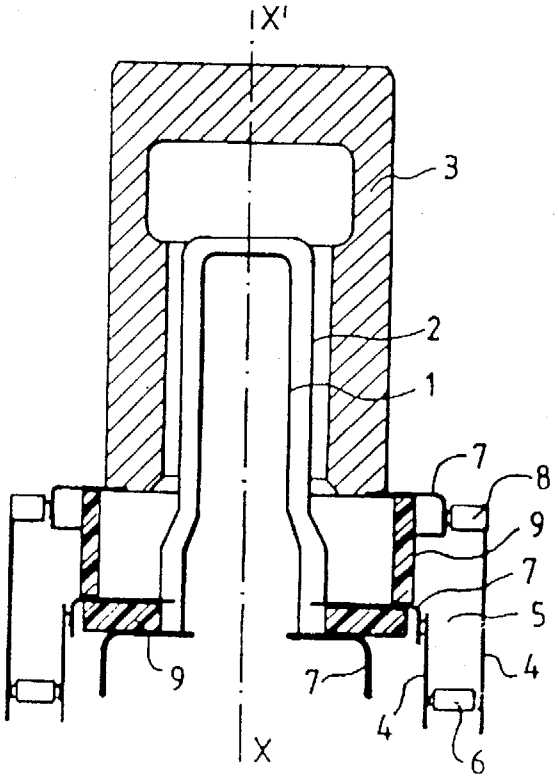
FIG. 1 PRIOR ART
FIG. 1, already described, a longitudinal section through a prior art grid electron tube of triode type.

FIG. 2*a* represents, in transverse section, a coaxial resonator of an electron tube with coaxial cylindrical electrodes in accordance, for example, with that represented in FIG. 1. It is assumed that the section has been cut through the active part of the anode 3 and only the control grid 2 is represented. The section could have been cut through the resonant cavity which extends the anode and the grid. The anode 3 forms the outer wall of the resonator and the control grid 2 the inner wall. In this section the magnetic field lines are drawn dashed and the electric field lines are drawn solid for the TE11 mode. Two magnetic field nodes may be seen, represented by the diametrically opposed points s and s', in the region of the internal surface of the outer wall of the resonator. The electric fields are substantially radial in this section.

Figure 2B:
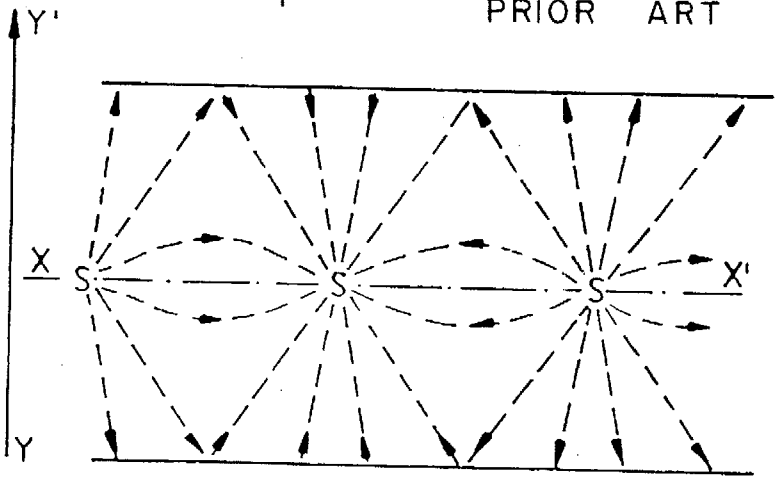
FIG. 2b PRIOR ART
FIG. 2*b:* the paths of the surface currents generated by the TE11 mode over one half of the internal surface of the external wall of the prior art coaxial resonator of FIG. 2*a;*

FIG. 2*b* represents half the circumference of the internal surface of the outer wall of the resonator of FIG. 2*a*. The half-circumference is taken on either side of the point s. The dashed lines represent the distribution of the surface currents which are set up in this wall for the TE11 mode. These currents have a component directed along the axis YY' which is normal the axis XX' of the tube and in the plane of the developed wall. This amounts to saying that these currents all have a component tangential to the outer wall of the coaxial resonator. The same is true in the inner wall of the resonator.

The other undesirable modes of TE type also generate currents having a tangential component in the inner and inner walls of the coaxial resonator. By contast, the currents generated by the TEM useful mode are directed longitudinally along the axis XX' and have no tangential component.

According to the invention, electrically conducting resistive elements are inserted into at least one of the walls of the resonator, in such a way that they attenuate the surface currents created in this wall by the undesirable mode or modes. The surface currents traverse these resistive elements and dissipate energy therein in the form of heat. The unwanted waves giving rise to these surface currents are thus attenuated.

Figure 3A:
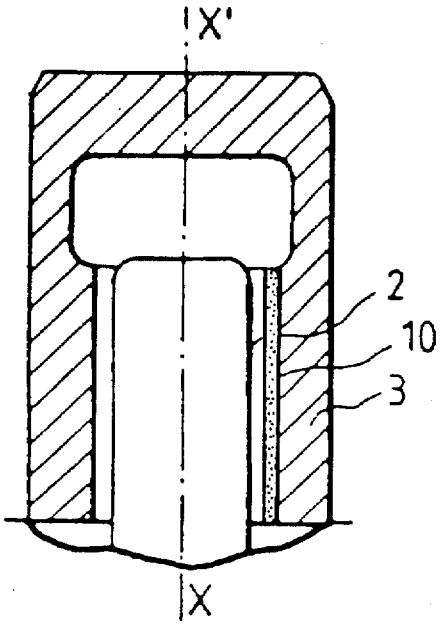
FIG. 3*a* and FIG. 3*b:* longitudinal and transverse sections respectively through the grid and through the anode of a tube with coaxial cylindrical electrodes and furnished with an attenuation device according to the invention.
Figure 3B:
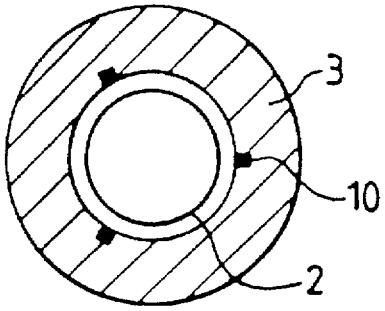

FIGS. 3*a*, 3*b* represent respectively a longitudinal section and a transverse section through an output resonator circuit of a grid tube furnished with an attenuation device according to the invention. The resistive elements are bars 10 inserted into the internal wall of the anode 3 along generatrices. These bars 10 are facing the control grid 2 and consequently are bombarded by the electrons emitted by the cathode. These bars attenuate the modes which generate surface currents having a tangential component while leaving the surface currents which have only a longitudinal component unperturbed.

Figure 4A:
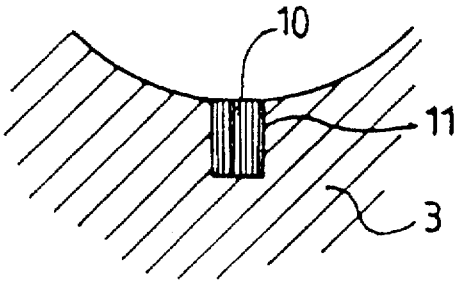
FIGS. 4*a* and 4*b:* a detail of the resistive elements of the attenuation device according to the invention.

Referring to FIG. 4*a*. These bars 10 will advantageously be right parallelepipeds and in the example described there are three of them. Grooves 11 have been made in the inner wall of the anode 3 and the bars are fixed into the grooves 11 by brazing for example. In order not to perturb the TEM mode it is preferable to limit the area of the bars 10 offered for electron bombardment.

The bars 10 are made from an electrically conducting resistive material. Pyrolitic graphite is a material which is particularly beneficial in the making of these bars. Pyrolitic graphite also called oriented graphite is essentially a crystallized graphite obtained by thermal decomposition of a gaseous hydrocarbon at the surface of a material brought to very high temperature in a controlled environment. A layer of graphite is thus deposited. Pyrolitic graphite has an electrical anisotropy which is related essentially to its crystallographic structure. In a direction (called the C axis) normal to the plane of deposition, its electrical resistivity is much larger than in a direction parallel to the plane of deposition. If the graphite of the bars is oriented in such a way that the plane of deposition is radial, the resistance of the bars 10 will be greater than that obtained with other orientations. The losses in the coaxial resonator will then be higher.

Figure 4B:
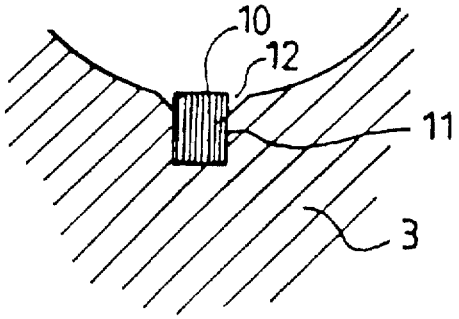

Furthermore, the heat resulting from the electron bombardment of the anode 3 and from the thermal dissipation related to the surface currents will benefit from the good thermal conductivity of the pyrolitic graphite in a direction parallel to the plane of deposition. This heat will be easily removed from the anode. FIGS. 4*a* and 4*b* show the orientation of the layers of the pyrolitic graphite.

To further improve the attentuation of the unwanted modes, chamfers 12 may be made on the sides of the grooves 11. This is illustrated by FIG. 4*b*. The cross section of the bars 10 has not been modified as compared with FIG. 4*a*.

It is preferable to use an odd number of resistive elements so as not to impose a preferred position for the setting up of an unwanted mode. Indeed, the surface currents generated in the walls of the resonator have, along the periphery, an even number of current nodes. In the outer wall, these nodes (for the TE11 mode) are stationed on generatrices passing through the points s and s' represented in FIG. 2*a*. If two resistive bars only were stationed at these locations, the TE11 mode could be set up without in fact being attenuated since these resistive bars would not cut the surface currents generated by the unwanted mode.

Figure 5:
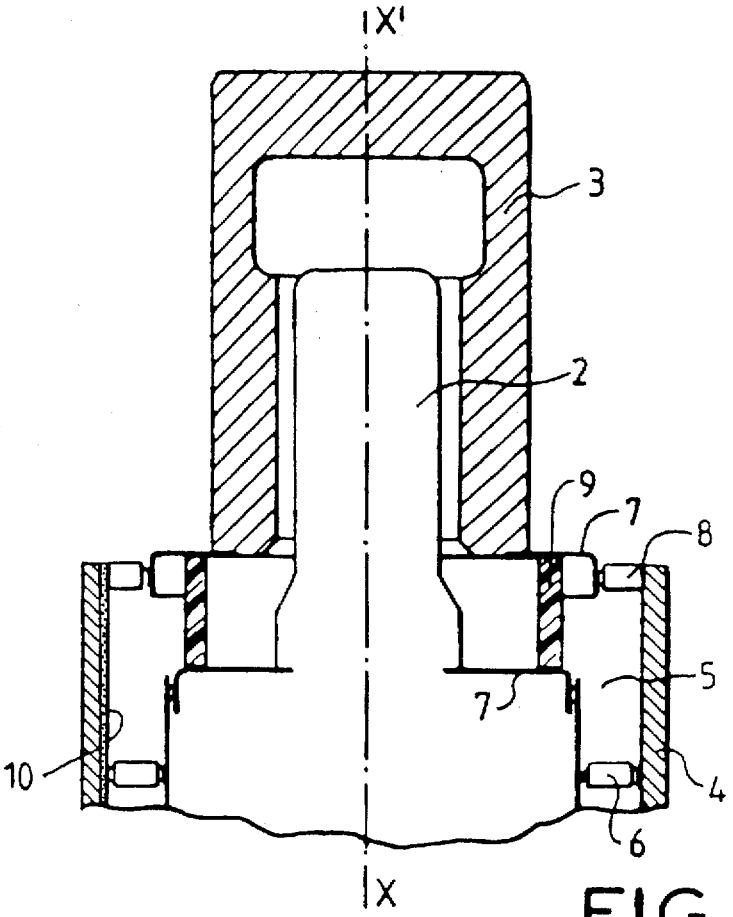
FIG. 5: a partial longitudinal section through a grid tube furnished with an attenuation device according to the invention.
Figure 6:
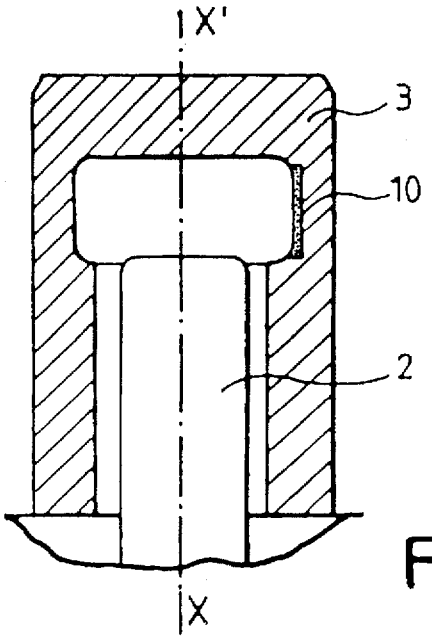
FIG. 6: a detail of an anode of a grid tube furnished with an attenuation device according to the invention.

In the example just described, the resistive elements were stationed in the anode. It is conceivable to station the resistive elements at another location but still in at least one of the walls of the resonator. In FIG. 5 the resistive elements are inserted into the outer wall of the resonant cavity 5. It is of course also conceivable for the resistive elements 10 to be inserted into the anode 3 but in the region of its upper part, above the grid 2, as FIG. 6 illustrates. In all the embodiments described, each resistive element is linked with one of the walls of the coaxial resonator since the resistive elements are inserted directly into the walls. In all the embodiments the electric field is radial in the region of the resistive elements.

The electron tube with coaxial cylindrical electrodes as described is a grid tube. This grid electron tube may be used in particular as a television amplifier or in a particle accelerator or even in an industrial installation employing high frequencies.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for attenuating unwanted waves which generate surface currents in an electron tube having a plurality of walls, comprising:

a plurality of coaxial cylindrical electrodes wherein each of said electrodes provide a respective one of said plurality of walls and said electrodes share an axis of rotation;

a plurality of electrically conducting resistive elements provided in grooves which are located in at least one of the plurality of walls, wherein said plurality of electrically conductive resistive elements are comprised of pyrolitic graphite, said pyrolitic graphite comprising layers which are oriented radially with respect to the axis of rotation.

2. A device for attenuating unwanted waves which generate surface currents in an electron tube having a plurality of walls, comprising:

a plurality of coaxial cylindrical electrodes wherein each of said electrodes provide a respective one of said plurality of walls and said electrodes share an axis of rotation;

a plurality of electrically conductive resistive elements provided in grooves which are located in at least one of the plurality of walls and directed substantially parallel to the axis of rotation to attenuate the surface currents generated by the unwanted waves in the electron tube.

3. The attenuation device according to claim 2, characterized in that the plurality of electrically conducting resistive elements are parallelelepipedal bars.

4. The attenuation device according to claim 3, characterized in that the plurality of electrically conducting resistive elements are inserted in a plurality of grooves located on the at least one of the plurality of walls.

5. The attenuation device according to claim 3, characterized in that the plurality of electrically conducting resistive elements are comprised of pyrolitic graphite.

6. The attenuation device according to claim 3, wherein the number of the plurality of electrically conducting resistive elements is odd.

7. The attenuation device according to claim 2, characterized in that the plurality of electrically conducting resistive elements are comprised of pyrolitic graphite.

8. The attenuation device according to claim 7, characterized in that the pyrolitic graphite comprises layers which are oriented radially with respect to the axis of rotation.

9. The attenuation device according to claim 7, wherein the number of the plurality of electrically conducting resistive elements is odd.

10. The attenuation device according to claim 2, characterized in that the at least one of the plurality of walls comprises an anode.

11. The attenuation device according to claim 2, characterized in that the number of the plurality of electrically conducting resistive elements is odd.

12. The attenuation device according to claim 2, characterized in that the plurality of electrically conducting resistive elements are inserted in a plurality of grooves located on the at least one of the plurality of walls.

13. The attenuation device according to claim 12, characterized in that the number of the plurality of electrically conducting resistive elements is odd.

14. The attenuation device according to claim 12, characterized in that the plurality of electrically conducting resistive elements are brazed elements.

15. The attenuation device according to claim 14, characterized in that the number of the plurality of electrically conducting resistive elements is odd.

16. The attenuation device according to claim 14, characterized in that the plurality of grooves have a chamfered edge.

17. The attenuation device according to claim 14, characterized in that the plurality of electrically conducting resistive elements are comprised of pyrolitic graphite.

18. The attenuation device according to claim 12, characterized in that the plurality of electrically conducting resistive elements are comprised of pyrolitic graphite.

19. The attenuation device according to claim 12, characterized in that the plurality of grooves have a chamfered edge.

20. The attenuation device according to claim 19, characterized in that the number of the plurality of electrically conducting resistive elements is odd.

21. The attenuation device according to claim 19, wherein the plurality of electrically conducting resistive elements are comprised of pyrolitic graphite.

* * * * *